United States Patent [19]

Geiser

[11] B 3,991,724

[45] Nov. 16, 1976

[54] APPARATUS FOR MOISTURE ADDITION TO ENGINE AIR-FUEL INPUT

[75] Inventor: Edward M. Geiser, Downers Grove, Ill.

[73] Assignee: Universal Oil Products Company, Des Plaines, Ill.

[22] Filed: Mar. 1, 1974

[21] Appl. No.: 447,440

[44] Published under the second Trial Voluntary Protest Program on February 17, 1976 as document No. B 447,440.

[52] U.S. Cl. ..... 123/25 R; 123/25 A; 55/233; 55/510; 261/18 A; 261/99

[51] Int. Cl.[2] ..... F02D 19/00

[58] Field of Search ..... 123/25 B, 25 D, 25 E, 123/25 N, 25 R, 25 A; 55/233, 510; 261/18 A, 99

[56] References Cited

UNITED STATES PATENTS

| | | | |
|---|---|---|---|
| 1,097,380 | 5/1914 | Weglein, Jr. | 123/25 N |
| 1,178,913 | 4/1916 | Garber | 123/25 N |
| 1,269,252 | 6/1918 | Brown | 123/25 N X |
| 1,489,827 | 4/1924 | Heckenlively | 123/25 B |
| 1,525,102 | 2/1925 | Moendi | 123/25 B |
| 1,611,530 | 12/1926 | Judia | 123/25 N |
| 2,580,013 | 12/1951 | Gazda | 261/99 X |
| 2,702,027 | 2/1955 | Drydyke | 123/25 N |
| 2,717,148 | 9/1955 | Hall | 123/25 A X |
| 2,843,216 | 7/1958 | Powell | 123/25 A |
| 3,834,360 | 9/1974 | Blitch | 123/25 A |

FOREIGN PATENTS OR APPLICATIONS

| | | | |
|---|---|---|---|
| 609,603 | 10/1948 | United Kingdom | 123/25 E |

*Primary Examiner*—Charles J. Myhre
*Assistant Examiner*—Ira S. Lazarus
*Attorney, Agent, or Firm*—James R. Hoatson, Jr.; Philip T. Liggett; William H. Page, II

[57] ABSTRACT

A portion of the air filter means ahead of an engine carburetor is provided as a porous water absorbent foam material and means is also provided to supply water or a water-alcohol mixture to the lower portion of the foam such that it will be wetted and impart moisture to the air stream passing through the air filter unit. A preferred unit automatically supplies fluid to the lower face of the foam material to maintain wetness and an open-cell foam material is also used which will effect a wick-like, capillary action to insure a wet porous surface for the air stream flow.

6 Claims, 3 Drawing Figures

APPARATUS FOR MOISTURE ADDITION TO ENGINE AIR-FUEL INPUT

Figure 1:
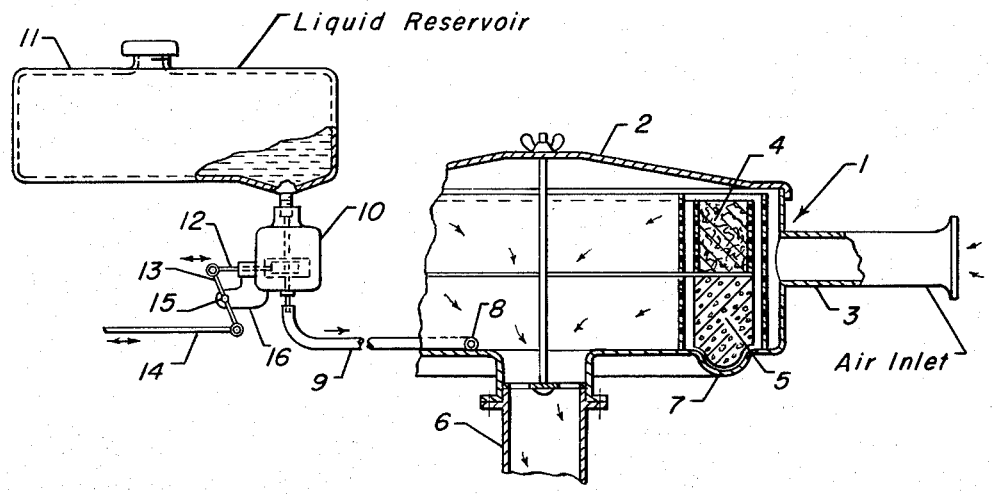

This invention relates to a simplified and improved form of air stream wetting apparatus for effecting moisture addition to an air-fuel stream to be charged to an internal combustion engine. More particularly, the present apparatus embodies means for continuously wetting a porous, air pervious element serving as at least a portion of the air filtering unit ahead of the engine carburetor, and effecting the wetting thereof by a wick-type (capillary) action.

It is generally known and recognized that the performance of an internal combustion engine is improved by the addition of intimately mixed moisture to the fuel stream, as long as the amount added is not excessive. The presence of the moisture in the fuel mixture can be found to improve combustion and decrease the octane requirements for a particular engine and lead to some overall economy in usage of fuel. The water addition can also provide for a lower combustion temperature which, in turn, will tend to decrease the nitrogen oxides ($NO_x$) emissions.

Some prior types of apparatus for adding moisture have used a container for bubbling the air stream therethrough. However, in the event of the freezing of the liquid in such type of arrangement there can be engine operation problems. In the present device, there should be a water-alcohol mixture for cold climate engine operations such that there is no freezing of the liquid mixture; however, where the moisture addition is accomplished by a wick action there is no blocking of air flow, even in the event of a freezing situation. In other words, with ice formation the fluid will cease to move upwardly and fill the foam such that ice crystals could cause any problem with air intake or, at most, there would only be partial blocking of the air flow to the carburetor.

In a broad aspect, it is an object of the present invention to provide a wetted foam surface to effect the moisture addition to an air-fuel stream for an internal combustion engine.

In a more particular aspect, it is an object of the present invention to have the foam surface as a part of the air intake filter means and also supply fluid to the lower portion thereof such that the foam is wetted from below by capillary action.

Thus, in one embodiment, the present invention is directed to an apparatus for providing moisture to the fuel-air mixture passing to the fuel intake means for an internal combustion engine, which comprises in combination, an air-pervious, wettable member for positioning in the air intake path to the engine and a holding means for said wettable member adapted for placement in the passageway means for said air intake path to said engine, a fillable liquid retaining means connecting to said holding means and positioned adjacent the lower portion of said wettable member for contact therewith and to effect wetting thereof, and means for at least periodically filling said water retaining means and maintaining fluid in contact with said wettable member, whereby the air stream to the fuel supply means will be humidified by passage through and over the surface of such member.

Preferably, the air pervious wettable member will be of a durable foam material, such as of polyurethane foam, latex, or the like, such that the member may provide self-wetting from a liquid reservoir in contact with the lower surface of the member. However, it is not intended to limit the present invention to any one material and suitable paper or cloth gauze-type of materials may be utilized, as well as open-weave, asbestos containing materials in the nature of wicking, which have the ability to provide capillary action and self-wetting from a liquid reservoir maintained below the material. The material may be held or positioned in any portion of the air intake passageway ahead of the carburetor or other type of fuel-air mixing means for the engine; however, for convenience, the wettable member may readily be positioned within the typical air filter housing which is conventionally supplied in combination with most automobile internal combustion engines. In other words, the member may be in a doughnut-like form and be placed concentrically along with a typical filter element or, optionally, the wettable member may comprise a lower portion of the air filter means such that it is positioned to traverse at least a portion of the air intake passageway through the air filter unit. Where the moisture supplying member is alongside of an air filter member or used to replace the air filter and serve as a dual function, then the wettable member may be the full height of the filter housing. However, generally it is preferable not to have the air pervious wettable member block the entire passageway inasmuch as clogging or possible freezing conditions which would permit ice crystals in the member to block the air passageway could cause engine misoperation.

In a preferred arrangement, the air pervious wettable member will be positioned in a lower portion of the air filter unit or within its own separate housing such as to be supplied by water or a water-alcohol mixture to a lower surface in a controlled manner. Typically, a reservoir with valve control means between the lower portion thereof and the holding means for the wettable member will provide for the supplying of fluid to the member and a desired regulated flow of fluid from the holding means. For example, the liquid reservoir may be a suitable container of plastic which can be periodically filled with water or a water-alcohol mixture that can provide for the wetting of the air stream. The valving means between the reservoir and the wetting member may be connected to the accelerator pedal being used for the operation of the engine of the vehicle such that fluid will be passed into the moisture addition section and into contact with the wettable member only during periods of engine operation. However, it is not intended to limit the present invention to any one type of valve operation or to any one linkage system. In a modified arrangement, there may be a valve opening responsive to the engine ignition key, rather than responsive to gas pedal operation.

In still another embodiment, there may be a heated filter and/or a heated liquid for wetting the moisture supplying member so as to increase liquid vaporization and added moisture content to the air stream. Heat may be supplied by circulation of hot engine coolant, hot exhaust gases, or by electric coil means.

Reference to the accompanying drawing and the following description thereof will serve to illustrate different embodiments of the present invention, as well as assist in pointing out advantages in the arrangement and operation of the moisture addition system.

FIG. 1 of the drawing is a diagrammatic view illustrating the positioning of an air pervious wettable member in a typical air filter unit ahead of a carburetor for an internal combustion engine.

Figure 2:
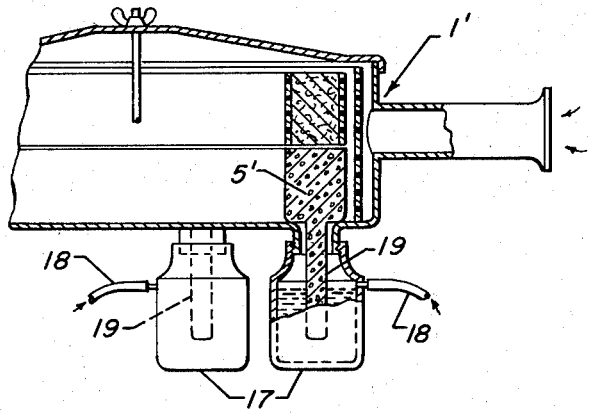

FIG. 2 of the drawing is a partial sectional view indicating a portion of a modified air intake filter unit with attached liquid holding reservoir means to be used in combination with a special wettable member having depending portions to serve as wick members.

Figure 3:
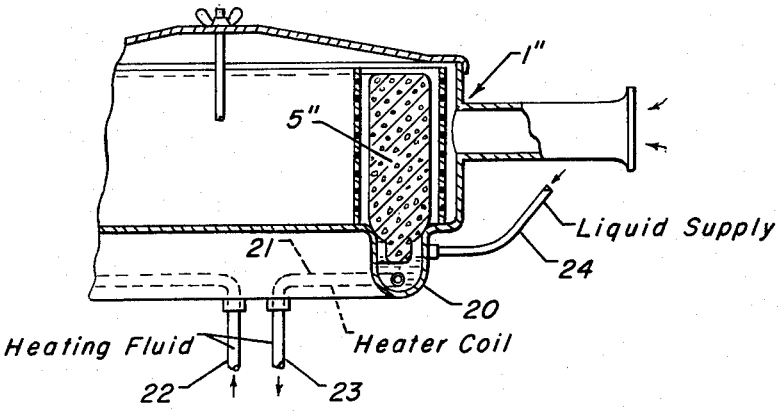

FIG. 3 of the drawing shows means for heating the liquid for the wettable member to enhance moisture addition to the air intake stream.

Referring now particularly to FIG. 1 of the drawing, there is indicated a portion of an air filter housing 1 with removable cover means 2 and an air intake horn means 3 which, in turn, is adapted to feed an air stream through an upper air filter member 4 and a lower air pervious wettable member 5. As is conventional with most automotive internal combustion engines, the housing 1 is indicated as being supported on the top air intake portion 6 for a carburetor unit, which need not be shown for purposes of the present invention.

The upper air filter member 4 may be of a foam material, metal mesh, pleated air pervious paper, or the like, in accordance with standard air filter construction systems, and the particular construction is in no way limiting with respect to the present invention. However, in accordance with this invention, at least a lower portion of the air passageway is traversed by an air pervious wettable member such as 5 which, in the present embodiment, is indicated as being of a foam material and in a doughnut form resting within a liquid holding depression 7 in turn extending circumferentially around the lower bottom portion of housing 1. The liquid retaining depression 7 is supplied with fluid from a port means 8 and pipe or tubing means 9 which, in turn, is connective with a valve means 10 positioned below a liquid reservoir 11.

The liquid reservoir may be of different sizes depending upon the size of the particular combustion engine and also may be constructed of various types of materials. Preferably it will be made of plastic or other material which is not readily subjected to cracking from jarring conditions or from expansion which might occur from water accidentally freezing under cold climate conditions. Stationary engines or such engines that will be used in a warm climate only may readily be constructed of glass or metal. In order to preclude any problems from freezing, the liquid retained in reservoir 11 and supplied to the wettable member 5 will preferably be a mixture of water and alcohol with the amount of alcohol being sufficient to preclude freezing under the temperature conditions to be encountered. However, it should be noted that it is a preferred feature of the present invention to provide for the wetting of member 5 from a lower surface only, such that in the event of freezing or crystal formation in the liquid retaining section 7 that such action will preclude further wetting of member 5 and little, if any, ice crystal formation will take place within the upper portion of the wettable moisture imparting member 5. In addition, in order to preclude any problems of air blockage to the engine, the preferred arrangement and positioning of the wettable member is such that it is within only a portion of the air path to the engine so as to not fully traverse the entire cross-sectional area of the passageway to the fuel intake system.

As hereinbefore pointed out, various types of valving means may be utilized to regulate fluid flow between the reservoir 11 and liquid retaining section 7, which in turn holds the wettable member 5. The present embodiment indicates that a slidable valve actuating member 12 may move back and forth to, in turn, block or open the liquid flow through the interior of the valving housing 10. The member 12 is moved responsive to a pivotable arm 13 and a linkage member 14, with the pivoting arm member 13 being supported from pin means at 15 held by a support arm means 16 extending from the valve housing 10. The linkage 14 may in turn connect to the gas pedal or accelerator means for the engine operation or, alternatively, may connect to the ignition switch means for the operation of the engine, such that valve 10 is only open at such periods of time as the engine is actually in operation. In other words, when the engine is not used, it is preferable to preclude liquid flow from reservoir 11 into contact with the moisture adding member 5 whereby the water can be constantly evaporated and lost without benefit to the engine operation.

It is to be understood that the shape and positioning of the air pervious wettable member 5 is optional and may be made in various forms and configurations although it is a particular feature and advantage of the present apparatus arrangement to have the liquid supply means be in contact with a lower portion of the wettable member, whereby it will effect its wetting through capillary action in the nature of a wick, or a sponge, and the like, and preclude the necessity of having wetting means feed to the top of the member. At the same time, as hereinbefore pointed out, the wick action is of advantage in precluding ice formation through the entire member and any unnecessary blockage of air flow to the air intake system of the engine.

In FIG. 2 of the drawing, there is indicated a modified form of open-cell foam member 5′ within an air filter housing 1′ which is adapted to have a plurality of removable liquid reservoirs 17 attached to the underside thereof. Each of the separate reservoirs 17 may be filled manually at periodic time periods or, if desired, suitable automatic means may be provided to maintain liquid in each one through separate conduit means 18 which would connect to a larger reservoir in the manner of container means 11 shown and described in connection with FIG. 1 of the drawing.

It is a particular feature of wettable member 5′ to have a plurality of depending leg portions 19 which can reach into each of the spaced reservoir means 17 such that again there is the ability to have wetting of the air pervious member 5′ from a lower surface thereof by capillary action and the resulting imparting of moisture to the air stream which is passing through the intake housing 1′. Still other forms of water supply means to a lower portion of the foam member or other type of air pervious wettable member will be obvious to those familiar with engine air intake systems and to various types of wettable materials.

With reference to FIG. 3 of the drawing, there is indicated a still further modification where the wettable member is supplied with a heated liquid medium. Specifically, there is diagrammatically indicated that the air filter housing 1″ is provided with a lower liquid holding section 20 which, in turn, is provided with an internal heater coil 21 that is indicated as being supplied with a heating medium by way of the respective inlet and outlet lines 22 and 23. The heating medium may be a by-pass stream from the engine cooling system such that it may comprise hot water or a typical water-"anti-freeze " mixture as used in an automobile radiator. As an alternative, there may be a slightly larger tubular means supplying a stream of hot exhaust gases from the engine exhaust gas manifold. In still another arrangement, there may be an electrical resistance coil within or in contact with the water holding section 20 and the electrical energy supplied to the coil from the engine battery.

The present embodiment also indicates the wettable member 5'' as extending for the full height of the air filter housing such that it is serving a dual purpose as a means for filtering the air intake for the air-fuel mixture and the means for imparting moisture into the air stream. The heating arrangement will, of course, enhance the vaporization of the liquid and increase the moisture content of the resulting air stream passing to the carburetor, as hereinbefore noted. The liquid supply line 24 may connect to liquid reservoir means and to a valve type regulating means such as indicated in connection with FIG. 1 of the drawing, or with other equivalent forms of liquid supply means.

It will also be obvious that variations may be provided in locating and positioning the wettable air pervious member in the air intake path to the fuel intake system of an engine such that the member need not be physically housed within a normal or conventional filter housing. In other words, the member may be in a similar type of housing placed in series with the air filter housing means rather than in combination therewith.

I claim as my invention:

1. In an internal combustion engine, means for providing moisture to the fuel-air mixture passing to the fuel intake means for said engine, said first named means comprising in combination, a. an air intake means to said engine, an upper air filter element and an air pervious wettable member positioned therebelow and adjacent thereto, said element and member being disposed adjacent to said air intake means, said member being positioned in only a portion of the flow path of air from said air intake means, b. a holding means for said wettable member, c. a fillable liquid retaining means in interconnection with said holding means and positioned adjacent the lower portion of said wettable member for contact therewith and to effect wetting thereof only from the lower surface thereof whereby, under freezing conditions, ice formation in the upper portion of said wettable member is precluded, and d. means for at least periodically filling said liquid retaining means to maintain fluid in contact with said wettable member, whereby the air stream to the fuel supply means will be humidified by passage through and over the surface of said wettable member.

2. The apparatus of claim 1 further characterized in that said wettable member is of open-cell foam material which can be wetted by capillary action from fluid supplied to a lower surface thereof.

3. The apparatus of claim 1 further characterized in that said holding means for said wettable member is provided as a part of an air intake filter means to the engine.

4. The apparatus of claim 3 further characterized in that said wettable member is of an open-cell foam material and is placed in a concentric arrangement adjacent to an additional air filter means in an air intake filter means for said engine.

5. The apparatus of claim 1 further characterized in that a separate liquid holding reservoir means connects with said holding means to supply liquid thereto and valve means is provided in the passageway means between said reservoir and said holding means to control fluid flow therebetween.

6. The apparatus of claim 4 still further characterized in that said valve means operates responsive to linkage connecting to accelerator pedal means whereby liquid is permitted to flow from the reservoir during such period as the accelerator pedal is operated responsive to accelerator pedal movement.

* * * * *